United States Patent [19]

Cates et al.

[11] Patent Number: 4,749,378

[45] Date of Patent: Jun. 7, 1988

[54] PROCESS FOR IMPROVING THE FLAME-RESISTANT PROPERTIES OF ARAMID FIBERS

[75] Inventors: Barbara J. Cates, Greensboro; Tanya E. FitzGerald, Fuqua-Varina; James K. Davis; Ernest J. Russell, both of Greensboro, all of N.C.

[73] Assignee: Burlington Industries, Inc., Greensboro, N.C.

[21] Appl. No.: 906,380

[22] Filed: Sep. 12, 1986

Related U.S. Application Data

[63] Continuation-in-part of Ser. No. 863,038, May 14, 1986, Pat. No. 4,710,200, and a continuation-in-part of Ser. No. 870,523, Jun. 4, 1986.

[51] Int. Cl.[4] ..... D06P 5/00

[52] U.S. Cl. ..... 8/130.1; 8/115.56; 8/115.57; 8/115.64; 8/490; 8/529; 8/531; 8/572; 8/584; 8/586; 8/587; 8/925

[58] Field of Search ..... 8/490, 529, 531, 130.1, 8/115.64, 490

[56] References Cited

U.S. PATENT DOCUMENTS

| | | | |
|---|---|---|---|
| 2,225,603 | 12/1940 | Lubs | 8/402 |
| 2,290,945 | 7/1942 | Dahlen et al. | 8/564 |
| 2,989,360 | 6/1961 | Mautner | 8/553 |
| 3,558,267 | 1/1971 | Langenfeld | 8/586 |
| 3,741,719 | 6/1973 | Ramanathan et al. | 8/654 |
| 3,771,949 | 11/1973 | Hermes | 8/492 |
| 3,789,091 | 1/1974 | Anderson et al. | 524/119 |
| 3,837,802 | 9/1974 | Litzler et al. | 8/549 |
| 3,849,368 | 11/1974 | Anderson et al. | 524/119 |
| 3,884,626 | 5/1975 | Hoster et al. | 8/543 |
| 3,986,827 | 10/1976 | Dombchik | 8/527 |
| 4,059,403 | 11/1977 | Wolf et al. | 8/538 |
| 4,066,396 | 1/1978 | Wolf et al. | 8/489 |
| 4,525,168 | 6/1985 | Kelly | 8/130.1 |

FOREIGN PATENT DOCUMENTS 1282113 7/1972 United Kingdom .

OTHER PUBLICATIONS

"Dyeability of Nomex Aramid Yarn", by R. A. F. Moore et al, *Textile Research Journal*, pp. 254–260, 1985.

"Effect of Auxiliary Solvents in STX Coloration of Aramids and PBI with Cationic Dyes", in *Book of Papers, AATCC National Technical Conference*, Oct. 1983, pp. 314–326.

"Dyeing and Finishing Nomex Type 450 Aramid", *Bulletin NX-9*, Mar. 1978.

"Interactions of Nonaqueous Solvents with Textile Fibers", Part XI: Nomex Shrinkage Behavior, *Textile Res. J.*, 51, 323–331 (1981).

"Dyeability of Solvent Treated Fibers", *Book of Papers, AATCC National Technical Conference*, Moore et al, Oct. 1981, pp. 109–120.

"Interactions of Nonaqueous Solvents with Textile Fibers", Part II: Isotherman Shrinkage Kinetics of a Polyester Yarn, *Textile Res. J.* 43, 176–183 (1973) Ribnick et al.

"Interactions of Nonaqueous Solvents with Textile Fibers", Part III: The Dynamic Shrinkage of Polyester Yarns in Organic Solvents, *Textile Res. J.*, 43, 316–325 (1973) Ribnick et al.

"Interactions of Nonaqueous Solvents with Textile Fibers", Part VII: Dyeability of Polyester Yarns After Heat and Solvent-Induced Structural Modifications, *Textile Res. J.* 46, 574–587 (1976), Weigmann et al.

(List continued on next page.)

*Primary Examiner*—A. Lionel Clingman
*Attorney, Agent, or Firm*—Nixon & Vanderhye

[57] ABSTRACT

Aramid fibers, polybenzimidazole fibers or blends of aramid and polybenzimidazole fibers are rendered flame resistant by a flame retardant introduced into the fibers by a polar organic swelling agent such as DMSO. Dyed or undyed fibers so treated exhibit substantially improved flame resistance as compared with untreated fibers.

19 Claims, 1 Drawing Sheet

OTHER PUBLICATIONS

"Evaluation of the STX System for Solvent Dyeing of Industrial Fabrics Part II: Kevlar Aramid and PBI Fabrics", Cook et al, *Journal of Industrial Fabrics,* vol. 2, No. 1, Summer 1983.

"Dyeability of Nomex Aramid Yarn", Moore et al, *Book of Papers, 1982 Technical Conference", pp. 94–99 (19).*

"High-Temperature Fibers and Their Identification", Prof. Maria Stratmann, *Melliand Textilberichte,* (English Edition), Mar. 1982, pp. 215–219.

"A Solvent-Dyeing Process for Aramid Fibers", J. Preston et al, *Textile Research Journal,* May 1979, vol. 49, No. 5, pp. 283–287.

PROCESS FOR IMPROVING THE FLAME-RESISTANT PROPERTIES OF ARAMID FIBERS

CROSS-REFERENCE TO RELATED APPLICATIONS

This application is a continuation-in-part of earlier application Ser. No. 863,038 filed May 14, 1986 now U.S. Pat. No. 4,710,200 which issued Dec. 1, 1987 and a continuation-in-part of earlier application Ser. No. 870,523 filed June 4, 1986.

This invention relates to a process for improving the flame-resistant properties of dyed or undyed aramid fibers, including poly(m-phenyleneisophthalamide); polybenzimidazole (PBI) fibers and blends of poly(m-phenylenisophthalamide) and PBI. More particularly, this invention relates to improving the flame-resistant properties of aramid and PBI fibers in which a flame retardant is introduced into the fiber while the fiber is in a solvent-swollen state.

BACKGROUND OF THE INVENTION

Aramid and PBI fibers are highly resistant to heat decomposition, have inherent flame resistant properties and are frequently used in working wear for special environments where flame resistant properties are required. Fabrics made of these fibers are extremely strong and durable, and have been widely adopted for use in the protective clothing field, particularly for military applications where personnel have the potential to be exposed to fire and flame, such as aircraft pilots, tank crews and the like. Various end uses for protective textile materials have different performance requirements. Fibers that are inherently flame resistant such as Nemox, PBI and Kevlar each have their own flame-resistant performance properties and are targeted for specific markets and applications. The process of this invention provides a means to increase the already excellent flame resistance values of such fibers and to "upgrade" certain fibers so that they may be used in applications for which they would not be otherwise qualified absent such treatment. In addition, enhanced flame resistant properties for fibers that are inherently flame resistant is always desirable.

There is a need for aramid, PBI and aramid/PBI blended fabrics that have flame resistant properties greater than that of the original fabric, dyed or undyed. As used herein, the term aramid fiber or fibers refers to meta-linked aromatic polyamide fibers made from high molecular weight polymers that are highly crystalline and have either a high or no glass transition temperature. These inherent desirable properties of aramid fibers also create difficulties for fiber processing in other areas; specifically, it is difficult to increase the inherent flame resistant properties of aramids to any significant extent with a durable flame retardant that withstands repeated launderings.

Aramid fibers suitable for the process of this invention include both dyed and undyed fibers. Dyed fibers from any source are successfully flame-retardant-treated, including those dyed using a polar organic solvent as a fiber swelling agent to introduce the dye into the fiber while in the swollen state. Procedures for dyeing and aramid fibers so produced are described in detail in copending, commonly assigned application Ser. No. 863,038 filed May 14, 1986, the disclosure of which is incorporated by reference.

Another source of dyed aramid fiber is the solution-dyed product, which is available from the fiber producer. In solution dyeing, a quantity of dye or pigment is mixed with the resin solution prior to extrusion of the resin into fine fibers; the dye or pigment becomes part of the fiber structure.

A further source of dyed aramid fibers results from the process described in U.S. Pat. No. 4,525,168 in which acid or anionic dyes are introduced into aramid fibers by coupling the dye to a dye site receptor which, in turn, is attached to the fiber.

It is an object of the present invention to provide a continuous process for improving the flame resistance of aromatic polyamide fibers, and blends of aramids such as Nomex with PBI either dyed or undyed, that will yield fibers having flame resistance greater than untreated fibers without detracting from the strength properties of the aramid fibers. Another object of this invention is to provide a continuous process adapted to enhance the already high flame resistance of solution dyed aramid fibers.

BRIEF DESCRIPTION OF THE DRAWINGS

The process of the invention may take several forms, as illustrated in the attached drawings, in which.

SUMMARY OF THE INVENTION

Figure 1:
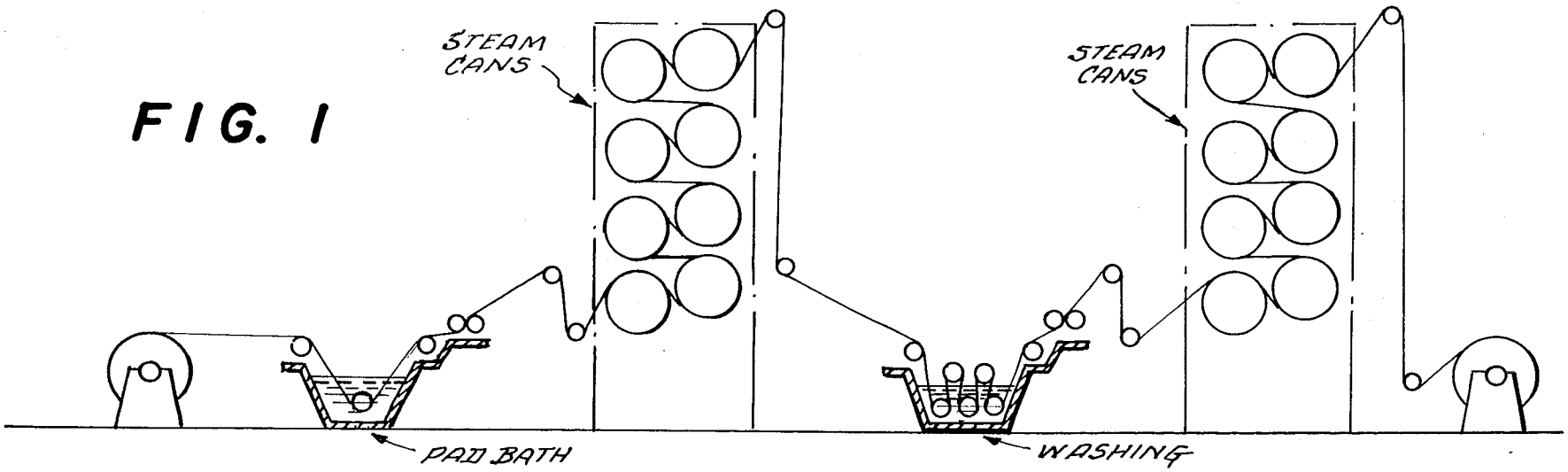
FIG. 1 is a schematic illustration of a process of applying a flame retardant or flame retardant system plus the swelling agent from a hot pad bath to an aramid-fiber-containing fabric, or blend of aramid with PBI, or a fabric composed entirely of PBI, fixing the flame retardant and drying the fabric over a stack of steam cans, washing to remove any residual swelling agent and/or flame retardant, drying the fabric on a second set of steam cans, and taking the treated fabric up on a roll.

Disclosed is a continuous or semi-continuous process for improving the flame resistance of aramid fibers, PBI fibers or blends of these two fibers that includes the step of introducing the fiber into a fiber swelling agent solution also containing at least one flame retardant, thereby swelling the fiber and introducing the flame retardant into the fiber while in the swollen state.

Flame resistance of fabrics dyed and simultaneously flame-retardant treated by the process of this invention is significantly improved, far better than if after-treated with a flame-retardant finish applied from an aqueous solution. As an illustration, Limiting Oxygen Index (LOI) values, as described in more detail below, may be as high as 0.44 or greater for the flame-retardant-treated Nomex or Nomex/PBI fabric produced by the process of this invention. As a means of comparison, greige T-455 Nomex has an LOI of 0.261, and untreated PBI has an LOI of 0.41. Durability of the flame resistant products is excellent when assessed by scouring at the boil and when subjected to multiple home launderings.

Fiber swelling is accomplished in an aqueous solution of one or more fiber swelling agents. The following polar organic solvents have been found to be preferred swelling agents for aramid fiber:

N-methylpyrrolidone
dimethylsulfoxide (DMSO)
dimethylacetamide (DMAc)

Conveniently, these swelling agents may be mixed with a compatible diluent, usually water, in various amounts; the swelling agent is present in a major amount, that is, more than half of the total weight of the solution.

Currently there are three types of Nomex available. T-450 is 100% poly(m-phenyleneisophthalamide) and is undyed; T-456 is type 450 that has been solution-dyed or producer-dyed, as described above; T-455 is a mixture of 95% Nomex with 5% Kevlar, the para isomer. This application describes the continuous dyeing and flame-retardant treatment of Nomex T-455 and Nomex T-450/PBI blends and reports flame-resistance properties markedly superior to either greige fabric or solution-dyed T-456 Nomex; see Examples I and II, below.

Fiber damage can be mitigated or avoided by including an otherwise inert and compatible diluent such as water or the flame-retardant compound itself in the swelling agent system.

An important application of fabrics made of aramid fibers or aramid fibers blended with PBI fibers is the protection of military personnel. To be fully acceptable for military applications, flame-retardant-treated aromatic polyamide fabrics must meed minimum strength requirements. For convenience, comparison of the undyed (greige) 80/20 Nomex/PBI fabric with the solution dyed Nomex T-456 fabric and the flame-retardant-treated Nomex/PBI fabric resulting from the process herein described will be made in Example I. Highly polar organic solvents are notorious for degrading mechanical properties of aramid-type fibers, possibly by dissolving or solvating the polymer. To accommodate for this potential concern, the swelling agent system selected, when used at the appropriate temperatures and under the appropriate processing conditions, will result in an aromatic polyamide or Nomex/PBI fiber blend or fabric exhibiting at least 80%, preferably at least 90% if not identical to the strength of either the greige fiber or fabric as the case may be. Expressed conversely, the successfully flame-retardant-treated fiber or fabric exhibits no more than a 20% loss in strength, and preferably far less strength loss, and still will be acceptable for most applications.

The swelling agent system is composed of an organic polar solvent, as described above, and optionally a compatible, miscible "inert" diluent (inert in the sense that it does not itself enter into or interfere with the flame-retardant fixing process) to minimize any damage that the polar organic solvent may cause to the fiber. It will be appreciated that the proportion of organic solvent to diluent, as well as the identity of each of the components, will vary depending upon several factors including the the nature of the specific aramid fiber to be treated, whether the fiber was previously dyed, and if so by which process, among others. Suitable swelling agents are selected from dimethylsulfoxide (DMSO), dimethylacetamide (DMAc), and N-methylpyrrolidone; DMSO is preferred. Suitable inert diluents include water, xylene (ortho, meta or para-dimethylbenzene), lower alkene glycols such as ethylene glycol and propylene glycol, alcohols such as n-propanol, methanol, benzyl alcohol, 4-butyrolactone, or the flame-retardant compound, all of which are compatible with DMSO as the swelling agent, or other relatively high boiling organic liquids otherwise suited to the flame-retardant process. The selection of swelling agent and diluent is guided by optimum flame resistance balanced with minimum fiber damage. Solvent-to-diluent ratios of up to 99:1 may be used and the diluent may include the flame retardant compound itself.

While we do not wish to be bound to any particular theory or mode of operation, our experience leads us to believe that the swelling agent modifies the aromatic polyamide fiber and the PBI fiber and allows the flame retardant or dye to enter the fiber. Examination by mass spectroscopy fails to reveal any swelling agent (in this case DMSO) in an aramid fiber treated by the process of this invention. The mechanism of flame retardant attachment to the fiber is less clear but is believed to be a physical entrapment rather than a chemical covalent bonding. The absence of swelling agent in the fiber following flame-retardant treatment provides an odor-free product, allowing the swelling agent to be more efficiently recovered and permits practice of the invention without untoward environmental concerns.

The flame-retardant agents are applied to the fibers, usually as a knit or woven fabric in open width, from a pad bath containing an amount of flame retardant sufficient to increase the inherent flame resistance of the fabrics. Other conventional means of applying the flame-retardant agents, such as spraying, may of course be used. Conventional flame retardants may be used provided that they are compatible with other components of the system, notably the swelling agent, and impart the required degree of flame resistance to the treated aramid or Nomex/PBI fibers. Flame retardant concentrations from 0.1% to about 20% are contemplated. However, as a practical matter, the upper limit will be determined by the degree of performance required for the finished product balanced against the cost of the flame retardant or flame retardant system used. Concentrations in the range of about 1% added FR chemical result in an LOI value of 0.30+ for the flame-retardant-treated fabric made in accordance with the present invention depending, of course, on the LOI value of the original, untreated fabric.

Fixation of the flame retardant is by heating such as using a tenter frame, drying on steam cans or the like.

Preferred flame retardants used in accordance with the present invention are thermally stable cyclic phosphonate esters prepared by reacting alkyl-halogen-free esters with a bicyclic phosphite. As a class these cyclic phosphonate esters are represented by one of the formulas:

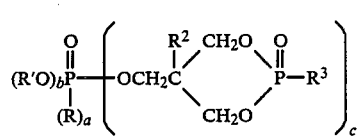

(A)

where a is 0 or 1; b is 0, 1 or 2, c is 1 or 2 and a+b+c is 3; R and $R^1$ are the same or different and are alkyl ($C_1$–$C_8$), phenyl, halophenyl, hydroxyphenyl, tolyl, xylyl, benzyl, phenethyl, hydroxyethyl, phenoxyethyl, or dibromophenoxymethyl; $R^2$ is alkyl ($C_1$–$C_4$); and $R^3$ is lower alkyl ($C_1$–$C_4$) or hydroxyalkyl ($C_1$–$C_4$) or

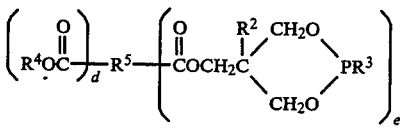

(B)

where d is 0, 1 or 2; e is 1, 2 or 3; $R^2$ is alkyl ($C_1$–$C_4$); $R^3$ is lower alkyl ($C_1$–$C_4$) or hydroxyalkyl ($C_{1-C4}$); $R^4$ is alkyl ($C_1$–$C_4$), phenyl, halophenyl, hydroxyphenyl, hydroxyethyl, phenoxyethyl, dibromophenoxyethyl, tolyl, xylyl, benzyl, or phenethyl; and $R^5$ is monovalent alkyl ($C_1$–$C_6$), chlorophenyl, bromophenyl, dibromophenyl, tribromophenyl, hydroxyphenyl, naphthyl, tolyl, xylyl, benzyl, or phenethyl; divalent alkylene ($C^1$–$C_6$), vinylene, o-phenylene, m-phenylene, p-phenylene, tetrachlorophenylene (o, m, or p), or tetrabromophenylene (o, m, or p); or trivalent phenyl.

The preferred compounds are represented by the formula:

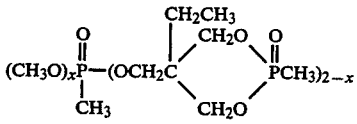

in which x is 0 or 1, and usually a 50:50 mixture of the mono-and di-esters. The preparation of these cyclic phosphonate esters and their use as flame retardants are described in U.S. Pat. Nos. 3,789,091 and 3,849,368, the disclosures of which are hereby incorporated by reference.

In addition to the swelling agent, the inert diluent(s) and/or the flame retardant(s), the customary pad bath additives and auxiliaries may be included, such as softeners (to improve hand), UV absorbing agents, IR absorbing agents, antistatic agents, water repellants, antifoaming agents, dyestuffs and the like. Alternatively, these and other treatments may be applied to the fabric as a post-treatment finish after flame retardant treatment, dyeing (when used), heating, washing and drying are completed. Preferably the treated fabric is water washed to remove any residual swelling agent remaining on the fabric.

Figure 2:
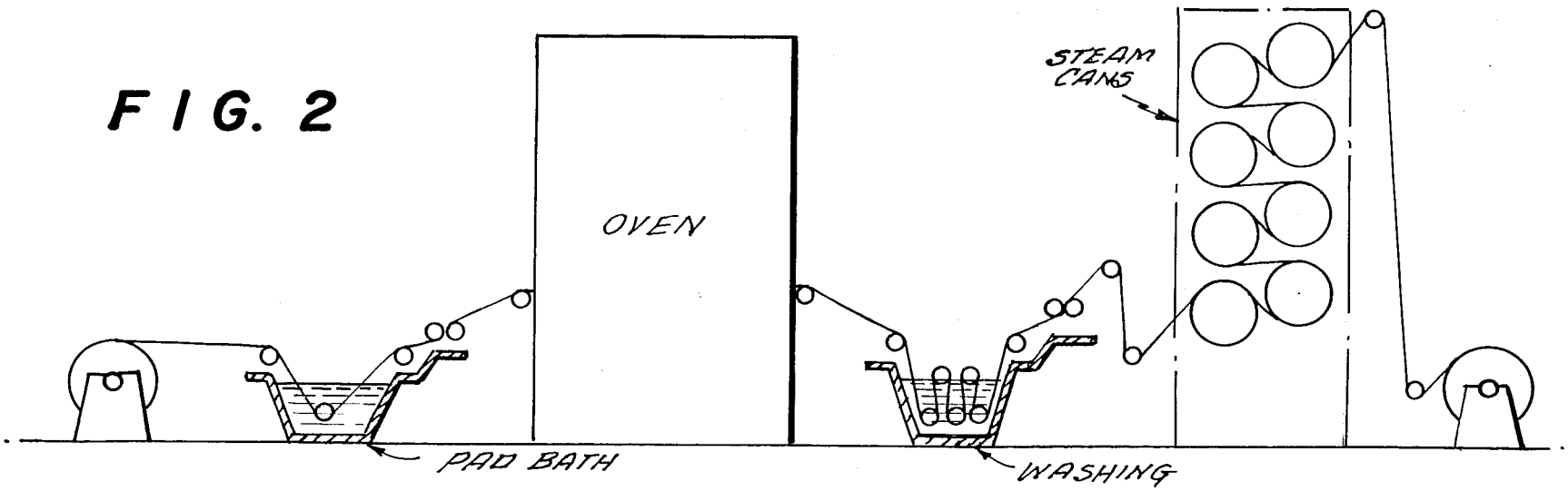
FIG. 2 is a schematic illustration of applying the flame retardant and swelling agent from a pad bath onto the fabric as specified above, drying and fixing the flame retardant to the fabric in a tenter over, followed by washing and drying on a stack of steam cans.

The physical form of the fiber to be flame-retardant-treated is also open to wide variation at the convenience of the user. Most textile treatment operations and equipment are suited to woven or knit fabrics in the open width as illustrated in FIGS. 1–2.

Testing procedures that were used in the examples are described in detail as follows:

FR Federal Test Method 5903 is intended for use in determining the resistance of cloth to flame and glow propagation and tendency to char. A rectangular cloth test specimen (70 mm×120 mm) with the long dimension parallel to the warp or fill direction is placed in a holder and suspended vertically in a cabinet with the lower end ¾ inch above the top of a Fisher gas burner. A synthetic gas mixture consisting primarily of hydrogen and methane is supplied to the burner. After the specimen is mounted in the cabinet and the door closed, the burner flame is applied vertically at the middle of the lower edge of the specimen for 12 seconds. The specimen continues to flame after the burner is extinguished. The time in seconds the specimen continues to glow after the specimen has ceased to flame is reported as afterglow time; if the specimen glows for more than 30 seconds, it is removed from the test cabinet, taking care not to fan the glow, and suspended in a draft-free area in the same vertical position as in the test cabinet. Char length, the distance (in mm) from the end of the specimen, which was exposed to the flame, to the end of a lengthwise tear through the center of the charred area to the highest peak in the charred area, is also measured. Five specimens from each sample are usually measured and the results averaged.

FR Federal Test Method 5905, flame contact test—a measurement of the resistance of textiles and other materials to flame propagation that exposes the specimen to the flame source for a longer period of time than text method 5903. A test specimen the same size as in the above method is exposed to a high temperature butane gas flame 3 inches in height by vertical suspension in the flame for 12 seconds, the lowest part of the specimen always 1.5 inches above the center of the burner. At the end of 12 seconds, the specimen is withdrawn from the flame slowly, and afterflaming is timed. Then the specimen is re-introduced into the flame and again slowly withdrawn after 12 seconds and any afterflame timed. For each 12-second exposure the results are reported as: ignites, propagates flame; ignites but is self-extinguishing; is ignition resistant; melts; shrinks away from the flame, or drops flaming pieces.

Limiting Oxygen Index (LOI) is a method of measuring the minimum oxygen concentration needed to support candle-like combustion of a sample according to ASTM D-2863-77. A test specimen is placed vertically in a glass cylinder, ignited, and a mixture of oxygen and nitrogen is flowed upwardly through the column. An initial oxygen concentration is selected, the specimen ignited from the top and the length of burning and the time are noted. The oxygen concentration is adjusted, the specimen is re-ignited (or a new specimen inserted), and the test is repeated until the lowest concentration of oxygen needed to support burning is reached.

Durability of the flame retardant on the fibers is assessed by washfastness. Durability of flame resistance is measured after the equivalent of 25 home launderings as an approximation of usual garment use.

The invention will now be explained with reference to the following examples in which all parts and percentages are reported by weight and temperatures reported in °F. unless otherwise indicated.

EXAMPLE I

Continuous flame-retardant treatment and dyeing of an 80/20 T-450 Nomex/PBI blended fabric was accomplished as follows: a pad bath was prepared containing 84.75 parts of DMSO, 4.5% of Acid Blue 62, 0.75% of Acid Black 172 and 10% of Antiblaze 19. One hundred yards of the fabric was padded at 190° F., squeezed at 20 psi, and passed over six steam cans at 220° F. while running at 30 yards/minute. The treated fabric was rinsed with water and then dried in a roller oven at 250° F.

The properties of the flame-retardant treated fabric, dyed Air Force Blue, are given in the fifth and last column of Table I.

TABLE I

| | Requirement MIL-C-83429A | Solution-Dyed T-456 Nomex | Greige Nomex/PBI*, 80/20 | Air Force Blue Nomex/PBI, 80/20 |
|---|---|---|---|---|
| Weight, oz/sq yd | 4.30 | 4.42 | 4.53 | 5.12 |
| Count, yarns/inch | | | | |
| warp | 70 | 69 | 71 | 71 |
| fill | 47 | 47 | 46 | 47 |
| Breaking Strength, "Grab" (lbs) | | | | |
| warp | 180 | 213.3 | 185.1 | 185.2 |
| fill | 100 | 162.4 | 126.8 | 127.7 |
| Air Perm., CFM | 25.0 | 96 | 107.0 | 147.8 |
| Flame Resistance FTM 5903 | | | | |
| warp sec. in. | | | | |
| afterflame | 2.0 max | 0 | 0 | 0 |
| afterglow | 25.0 max | 9.6 | 0 | 0 |
| char | 3.5 max | 1.3 | 0.74 | 0.54 |
| fill sec. in. | | | | |
| afterflame | 2.0 max | 0 | 0 | 0 |
| afterglow | 25.0 max | 10.8 | 0 | 0 |
| char | 3.5 max | 1.7 | 0.82 | 0.55 |
| LOI | — | .261 | .287 | .364 |
| after 15 laund. | | | .301 | .434 |
| Dimensional stability (15 la.) | | | | |
| warp | 4.0% max | | 4.9 | 3.0 |
| fill | 1.5% max | | 0.4+ | 3.2 |
| Colorfastness Light 20 hr. | | 4.0 | — | 4.0 |
| Color** | | | | |
| % Ret | | | | 98.45 |
| % Endu | | | | 94.89 |
| Resistivity 40% R.H. | $3.0 \times 10^{11}$ | $1.2 \times 10^{10}$ | | $4.5 \times 10^{11}$ |
| after 5 laund. | $8.0 \times 10^{11}$ | | | $1.9 \times 10^{13}$ |

*T-450 Nomex/PBI, 80/20
**Color
% Ret - color retained after scouring at the boil in detergent & soda ash
% Endu - color retained after AATCC 61-1975 IIIA For comparison, Table I includes the requirments of MIL-C-83429 A (column 2), the properties of solution-dyed T-456 Nomex (column 3), and the properties of the greige 80/20 Nomex/PBI blend (column 4). The results in Table I show a large improvement of Limiting Oxygen Index (LOI) as a result of the treatment, indicating improved flame resistance. There was no loss of grab breaking strength or other desirable properties compared to the greige fabric.

EXAMPLE II

Continuous dyeing of type 455 woven Nomex in open width was accomplished as follows: a pad bath was prepared containing 90 parts by weight DMSO and 10 parts by weight water to which was added dye and 10% Antiblaze 19, a cyclic phosphonate ester as defined above and in U.S. Pat. Nos. 3,849,368 and 3,789,091. The pad bath was padded onto style S/57431 Nomex at 180° F. from a heated bath at a speed of 30 yards per minute and run on heated cans at 230° F. The fabric was then rinsed in water at 120° F. and dried. As shown by the results in the last column of Table II, the flame-retardant-treated, dyed T-455 Nomex had flame resistance properties that were markedly superior to either the greige Nomex T-455 or the solution dyed T-456 Nomex.

TABLE II

| | Requirement MIL-C-83429A | Solution-Dyed T-456 Nomex | Greige T-455 Nomex | Khaki-Dyed T-455 Nomex |
|---|---|---|---|---|
| Weight, oz/sq yd | 4.30 | 4.42 | 4.48 | 4.90 |
| Count, yarns/inch | | | | |
| warp | 70 | 69 | 69 | 72 |
| fill | 47 | 47 | 47 | 46 |
| Breaking Strength "Grab (lbs) | | | | |
| warp | 180 | 213.3 | 186 | 175 |
| fill | 100 | 162.4 | 143 | 120.8 |
| Flame Resistance FTM 5903 | | | | |
| warp sec. in. | | | | |
| afterflame | 2.0 max | 0 | 0 | 0 |
| afterglow | 25.0 max | 9.6 | 0 | 0 |
| char | 3.5 max | 1.3 | 1.3 | 0.64 |
| fill sec. in. | | | | |
| afterflame | 2.0 max | 0 | 0 | 0 |
| afterglow | 25.0 max | 10.8 | 0 | 0 |
| char | 3.5 max | 1.7 | 1.3 | 0.66 |
| LOI | — | .261 | .261 | .442 |

TABLE II-continued

| | Requirement MIL-C-83429A | Solution-Dyed T-456 Nomex | Greige T-455 Nomex | Khaki-Dyed T-455 Nomex |
|---|---|---|---|---|
| Colorfastness Light 20 hr. | = or better | 4.0 | — | 3.5 |
| Color* | | | | |
| % Ret | | | | 97.25 |
| % Endu | | | | 92.98 |

*Color
% Ret - color retained after scouring at the boil in detergent & soda ash
% Endu - color retained after AATCC 61-1975 IIIA

EXAMPLE III

A sample of T-456 solution-dyed Nomex was padded with 15% of Antiblaze 19 in DMSO at a bath temperature of 130° F. The fabric was dried at 220° F., rinsed in water at 120° F., and dried. The results of tests made on the treated fabric are shown in the last column of Table III. For comparison, some of the military requirements and the properties of the untreated control fabric (solution-dyed Nomex T-456) are included in Table III. It is apparent that this treatment resulted in a marked improvement in flame resistance.

TABLE III

| | Requirement MIL-C-83429A | Solution-Dyed T-456 Nomex | FR-Treated T-456 Nomex |
|---|---|---|---|
| Count, yarns/inch | | | |
| warp | 70 | 69 | 70 |
| fill | 47 | 47 | 49 |
| Flame Resistance FTM 5903 | | | |
| warp sec. in. | | | |
| afterflame | 2.0 max | 0 | 0 |
| afterglow | 25.0 max | 9.6 | 0 |
| char | 3.5 max | 1.3 | 0.7 |
| fill sec. in. | | | |
| afterflame | 2.0 max | 0 | 0 |
| afterglow | 25.0 max | 10.8 | 0 |
| char | 3.5 max | 1.7 | 0.7 |
| after 5 la. warp | | | |
| afterflame | | | 0 |
| afterglow | | | 0 |
| char | | | 0.8 |
| fill | | | |
| afterflame | | | 0 |
| afterglow | | | 0 |
| char | | | 0.8 |
| after 25 laund. warp | | | 0 |
| afterflame | | | 0 |
| afterglow | | | 0 |
| char | | | 0.7 |
| fill | | | |
| afterflame | | | 0 |
| afterflow | | | 0 |
| char | | | 0.7 |
| LOI | — | .261 | .367 |
| after 25 laund. | | | .367 |

Other embodiments of the invention in addition to those specifically described and exemplified above will be apparent to one skilled in the art from a consideration of the specification or the practice of the invention disclosed herein. It is intended that the specification and examples be considered as exemplary only, with the true scope and spirit of the invention being indicated by the claims that follow.

What is claimed:

1. A process for flame-retardant treating fibers comprising the steps of:

(1) contacting a fiber selected from the group consisting of aramid fibers, polybenzimidazole fibers and blends thereof with a solution of an organic swelling agent adapted to swell said fiber and selected from the group consisting of N-methylpyrrolidone, dimethylsulfoxide, and dimethylacetamide and a solvent-compatible, thermally stable cyclic phosphonate ester flame retardant dissolved in said solution; and (2) heating the fiber treated in step (1) to fix said flame retardant to said fiber.

2. The process of claim 1, in which the fiber contacting solution is a mixture of said organic swelling agent, cyclic phosphonate ester flame retardant and water in a weight ratio of from about 99:1:0 to about 60:20:20.

3. The process of claim 2, in which the solution contains a mixture of dimethylsulfoxide, cyclic phosphonate ester flame retardant and water in a weight ratio of about 99:1:0 to about 60:20:20.

4. The process of claim 3, in which said solution contains a mixture of dimethylsulfoxide, cyclic phosphonate flame retardant and water in a weight ratio of about 80:10:10.

5. The process of claim 1 in which the fiber consists essentially of the aramid poly(m-phenyleneisophthalamide).

6. The process of claim 1 in which the fiber consists essentially of polybenzimidazole.

7. The process of claim 1 in which the fiber consists essentially of a blend of poly(m-phenyleneisophthalamide) and polybenzimidazole.

8. The process of claim 7 in which the weight ratio of poly(m-phenylenisophthalamide) to polybenzimidazole in the blend is about 80:20.

9. A process for flame retardant treating a fiber comprising the sequential steps of:

(a) contacting a swellable fiber selected from poly(m-phenyleneisophthalamide), a blend of poly(m-phenyleneisophthalamide) and polybenzimidazole with a solution containing (1) an organic polar solvent swelling agent selected from the group consisting of dimethylsulfoxide, N-methylpyrrolidone and dimethylacetamide, together (2) from 0.01 to 20% by weight of a solvent-compatible, thermally stable cyclic phosphonate ester flame retardant, and, optionally, (3) a compatible inert diluent to dilute the swelling agent and protect the fiber from degradation, and provided that the swelling agent is adapted to swell the fiber and allow the flame retardant to enter into and become fixed in the fiber, the swelling agent, flame retardant and inert diluent are present in proportions such that the mechanical strength of the treated fiber is at least 80% of the strength of the untreated fiber, and the fiber is contacted with flame retardant-containing solution, and (b) heating the fiber to fix the flame retardant in the fiber.

10. The process of claim 9 in which when present the diluent (3) is selected from the group consisting of water, xylene, ethylene glycol, lower alcohols, and 4-butyrolactone.

11. The process of claim 9 in which the fiber consists essentially of the aramid poly(m-phenyleneisophthalamide).

12. The process of claim 9 in which the fiber consists of essentially of polybenzimidazole.

13. The process of claim 9 in which the fiber consists essentially of a blend of poly(m-phenyleneisophthalamide) and polybenzimidazole.

14. The process of claim 9 in which the weight ratio of poly(m-phenyleneisophthalamide) to polybenzimidazole in the blend is about 80:20.

15. A woven or knit fabric having a Limiting Oxygen Index (ASTM D-2863-77) of greater than 0.30 in which the fibers are flame-retardant treated by the process of claim 11.

16. A process for simultaneously dyeing and flame-retardant treating a fiber selected from the group consisting of polybenzimidazole, and blends of high tenacity poly(m-phenyleneisophthalamide) with polybenzimidazole, said process comprising the steps of:

(1) contacting said fiber with a solution of an organic swelling agent adapted to swell said fiber and selected from the group consisting of N-methylpyrrolidone, dimethylsulfoxide, and dimethylacetamide, a solvent-compatible dyestuff and from about 0.01 to about 20% by weight of a solvent-compatible, thermally stable cyclic phosphonate ester flame retardant dissolved in said solution; and (2) heating said fiber treated in step (1) to fix said dyestuff and flame retardant to said fiber.

17. The process of claim 16 in which the fiber contacting solution is a mixture of said organic swelling agent, cyclic phosphonate ester, flame retardant and water in a weight ratio of from about 99:1:0 to about 60:20:20 and the solution contains a tinctorial amount of at least one dyestuff.

18. The process of claim 16 in which the fiber simultaneously dyed and flame-retardant treated consists essentially of a blend of high tenacity poly(m-phenyleneisophthalamide) fiber with polybenzimidazole.

19. The woven or knit fabric having a Limiting Oxygen Index (ASTM D-2863-77) of at least 0.43 in which the fibers consist entirely of polybenzimidazole and are dyed and flame-retardant treated by the process of claim 16.

* * * * *